United States Patent [19]

Moll et al.

[11] 4,090,943

[45] May 23, 1978

[54] COAL HYDROGENATION CATALYST RECYCLE

[75] Inventors: Norman G. Moll, Sanford; George J. Quarderer, Midland, both of Mich.

[73] Assignee: The Dow Chemical Company, Midland, Mich.

[21] Appl. No.: 772,873

[22] Filed: Feb. 28, 1977

[51] Int. Cl.[2] ..... C10G 1/08

[52] U.S. Cl. ..... 208/10

[58] Field of Search ..... 208/8, 9, 10

[56] References Cited

U.S. PATENT DOCUMENTS

| | | | |
|---|---|---|---|
| 2,118,940 | 5/1938 | Pier et al. | 208/10 |
| 3,532,617 | 10/1970 | Hodgson | 208/10 |
| 3,687,838 | 8/1972 | Seitzer | 208/10 |
| 3,893,943 | 7/1975 | Willard, Sr. | 208/8 |

*Primary Examiner*—Delbert E. Gantz
*Assistant Examiner*—J. Thierstein
*Attorney, Agent, or Firm*—D. H. Thurston

[57] ABSTRACT

In the hydrogenation of coal slurried in recycle oil in the presence of a suspended hydrogenation catalyst, a substantial proportion of the catalyst can be recovered for recycle to the process by using a catalyst which is significantly more finely divided than the ash particles from the coal, subjecting the hydrogenated slurry to a gravity concentration process whereby the coarser, ash particles are selectively concentrated in a lower layer and a relatively larger proportion of the finer catalyst particles remain suspended in the supernatant oil, and recycling at least a part of the supernatant oil containing suspended catalyst to the coal hydrogenation process.

9 Claims, No Drawings

COAL HYDROGENATION CATALYST RECYCLE

BACKGROUND OF THE INVENTION

This invention relates to an improvement in the process whereby coal is catalytically hydrogenated to liquid products. More particularly, it relates to a process whereby a metal-containing hydrogenation catalyst is recovered from a hydrogenated coal slurry in an active form suitable for recycle to the process.

A number of processes have been developed in recent years for hydrogenating coal, usually bituminous or sub-bituminous coal, to gaseous and liquid products. Both catalytic and noncatalytic hydrogenation processes are known. The presently more important catalytic processes fall generally into two classes, those wherein a stationary bed of pelleted or extruded catalyst is used and the so-called ebullated bed type of process wherein the coal-oil slurry feed and hydrogen flow upwardly through a bed of relatively fine particles of catalyst, thereby imparting a random turbulence or boiling movement to the catalyst particles to improve contact between the catalyst and the mixed feed. The catalysts used in both types of process are usually supported metal-containing catalysts such as cobalt molybdate on alumina, molybdenum oxide or sulfide on an aluminum silicate support, and the like.

Another type of catalytic coal hydrogenation process which has had less attention in recent years is that where a catalyst is added directly to the coal-oil slurry, usually as a decomposable metal salt, where it remains dispersed in the reaction mixture. This kind of process is illustrated by Pelipetz, U.S. Pat. No. 2,860,101 which describes the addition of molybdenum catalyst by the impregnation of the coal with a water-soluble molybdenum salt. The recovery of catalyst from the product of this kind of process is obviously more difficult than the recovery of spent catalyst from ebullated bed or stationary bed processes where the bulk of the catalyst is a relatively coarse granular material. Recovery of catalyst metal values from suspended fines in a hydrgenated product is usually accomplished by separation and chemical treatment of the fines. Johnson, U.S. Pat. No. 3,679,573 and Weber et al., U.S. Pat. No. 3,622,265 describe ebullated bed processes wherein catalyst particles are settled out of a reaction mixture and returned to the process.

These catalytic hydrogenations of coal are usually run at about 400° C–500° C and with about 1000–5000 psi hydrogen pressure. Crushed or pulverized coal is dispersed in a hydrocarbon oil, usually oil recycled from the process effluent, to make a feed slurry of 10–50 percent coal content.

In noncatalytic coal hydrogenation processes, the hydrogenation is facilitated by the large surface provided by relatively fine particles of ash in the coal and probably also by the metal content of the ash, primarily iron. Noncatalytic processes have been described where this surface effect is expanded by addition of more such solid particles in order to improve the relatively low conversion typical of this kind of process. For example, Wolk et al., U.S. Pat. No. 3,617,465 discloses a process wherein the ash content of an effluent product is concentrated by a preliminary distillation and at least a part of the ash-containing bottoms is recycled to the hydrogenation reactor.

SUMMARY OF THE INVENTION

In the process wherein a slurry of coal in oil is hydrogenated in the presence of a suspended metal-containing hydrogenation catalyst, it has been found that a substantial portion of the suspended catalyst can be recovered from the hydrogenated liquid effluent in catalytically active form suitable for recycle to the hydrogenation process by using a particulate catalyst substantially smaller in average diameter than the ash particles in the coal and subjecting the hydrogenated effluent to a gravity concentration process. By so doing, the liquid effluent forms two layers, a supernatant oil layer having suspended therein a comparatively large proportion of the relatively smaller particles of catalyst, and a lower heavy layer containing most of the coarser ash particles and some catalyst. The supernatant oil layer containing suspended catalyst is then recycled at least in part to the process as make-up oil for the coal slurry feed and only small amounts of fresh catalyst need be added to the coal slurry make-up to maintain the original catalyst level in the reaction mixture.

DETAILED DESCRIPTION OF THE INVENTION

The size limits of catalyst particles operable in the present invention are essentially relative to the average size of ash particles found in the particular coal being hydrogenated and for successful operation of the process, it is only necessary that the average size of the catalyst particles be significantly lower. Since the efficiency of a gravity-type separation of different sized suspended particles varies according to the square root of the ratio of their diameters, other factors being equal, preferably the average diameter of the ash particles is larger by a factor of at least about $\sqrt{2}$. In practice, ash particles remaining after the hydrogenation of some typical bituminous coals average at least ten microns in size. Under these conditions, the suspended catalyst particles in the hydrogenated slurry should average significantly less than ten microns in diameter and preferably about seven microns or less for best results.

There are, of course, factors other than particle size which affect settling rates. These include the densities of the particles and the liquid medium, the viscosity of the liquid, and the strength of the gravitational field. However, in the present process most of these additional factors are fairly well fixed and affect the separation of ash from catalyst only in minor degree. For example, the recycle oil medium remains about the same and its viscosity and density under process conditions are reasonably constant. Similarly, the density of the ash particles will not vary greatly. The density of the catalyst particles will vary somewhat, particularly if a supported catalyst is used, but since the process has been found to be successful using the relatively heavy unsupported catalyst, use of generally lighter supported catalysts would only improve its efficiency. Therefore, relative particle size remains the principal determining factor.

There are several ways by which catalyst in appropriately sized particles can be prepared for use in this improved process. A supported catalyst of the desired fineness can be made up by impregnating or coating a correspondingly sized particulate support material with a metal or metal compound according to known procedures. An unsupported catalyst can be formed by precipitation in very finely divided state or by pulverizing a coarser metal-containing solid. A convenient and preferred method for making a metal-containing catalyst of extremely small particle size is the method described in our concurrently filed application Ser. No. 772,874, wherein a water solution of a metal compound or mixture of metal compounds is emulsified in the recycle oil medium of a hydrogenation process, a coal hydrogenation process in particular, and the metal compound or compounds are converted under the conditions of the hydrogenation process to a catalytically active form. Ammonium heptamolybdate, alkali metal molybdates, cobalt nitrate, nickel nitrate, sodium tungstate, ferrous sulfate, and mixtures thereof are examples of water-soluble salts useful in this mode of catalyst preparation.

The selective separation of catalyst particles from particles of ash can be done by any convenient method based on a gravity concentration, by which term is meant both a conventional settling process where normal gravity is used to obtain a selective separation and a process where centrifugal force is used to apply an enhanced artificial gravity to accelerate the selective settling of suspended solids. Because of the much shorter time required, some type of centrifugal separator is ordinarily preferred over a settling tank although where a particular coal yields unusually coarse particles of ash, a settling tank type of operation can be practical. A continuously fed centrifuge is particularly preferred and a hydraulic centrifugal separator such as a hydrocyclone, often called a hydroclone, is especially adapted for use in this separation process. Also in the interest of shorter process time, the liquid separation is preferably done at an elevated temperature to reduce the viscosity of the suspending oil medium and thus improve the efficiency of operation of the hydrocyclone. A temperature from ambient temperature to a temperature just below the oil decomposition temperature, can be used. At the preferred higher temperatures particularly, the process is run under pressure to prevent extensive vaporization.

A gravity or centrifugal concentration can also be done in more than one stage or by using different types of gravity concentrator in multiple stages. Thus, a partial separation can be achieved in a first stage to obtain an upper oil layer containing suspended catalyst and a lower heavy layer still containing a substantial amount of oil with a significant quantity of suspended catalyst along with the concentrated ash particles, then subjecting the lower layer to a second concentration in a hydraulic centrifugal separator to produce a second upper oil layer containing suspended catalyst. In this way, a significant fraction of the catalyst originally present in the coal hydrogenation process effluent can be recovered as active catalyst suspended in oil and suitable for recycle. By this process from about 20 percent to as high as about 90 percent of the catalyst can be recovered for recycle as particles suspended in the oil product and under preferred conditions about 60–80 percent of the catalyst can be recovered in this way.

EXAMPLE 1

A solution of one part by weight ammonium heptamolybdate tetrahydrate in 3 parts of water was emulsified in recycle oil and added to a slurry of 40 percent high volatile bituminous coal-60 percent recycle oil to provide a molybdenum weight content of 220 parts per million. The slurry was then hydrogenated at 460° C and 2000 psi hydrogen pressure, using a tubular reactor through which the slurry was fed at a rate of 22.5 lb of coal per cubic foot of reactor space per hour. The hydrogen feed rate was approximately 23 cu ft per pound of coal measured at 25° C and atmospheric pressure. Effluent product from the reactor was passed through a heated flash separator maintained at 150° C and 10 psig pressure to give an aqueous phase product, a light oil distillate, and a heavy oil slurry. The latter amounted to about 85 percent of the total effluent. The heavy phase was put through a 10 mm I.D. hydrocyclone at 11.84 lb/min, 150° C, and 114 psi pressure drop, thereby yielding 22.7 weight percent as underflow and 77.3 percent as hydrocyclone overflow.

The liquid overflow was used as recycle oil to prepare a second coal slurry as described above with 220 ppm molybdenum added as before. This slurry was hydrogenated and the effluent product separated in the same way. The process was repeated again to obtain a third batch of hydrocyclone overflow for coal slurry make-up although this final slurry was not hydrogenated. Liquid cyclone separation ratios for each reactor pass are tabulated below. These are based on X-ray fluorescence measurements of metal content and ash level determinations by combustion in air to constant weight.

TABLE I

| Pass No. | Mo Content in feed, ppm | Concentration Ratio Underflow/Overflow | | |
|---|---|---|---|---|
| | | Ash | Fe | Mo |
| 1 | 220 | 4.6 | 6.3 | 5.5 |
| 2 | 288 | 3.6 | 4.5 | 1.5 |
| 3 | 372 | 3.6 | 3.8 | 1.7 |
| 4 | 440 | — | — | — |

It is evident from the above data that after the first pass where a nonuniform emulsion resulted in a typical catalyst separation, the hydrocyclone treatment separated the ash and iron (an ash component) efficiently while allowing large amounts of the catalyst to remain suspended in the overflow. As a result, catalyst concentration in the reactor feed was doubled after three cycles by the accumulation of molybdenum in the overflow oil. The particles of catalyst in the products from these coal hydrogenation runs had and average size of about 5 microns with about half the weight of the catalyst in particles of less than that size. The bulk of the ash was present as particles greater than ten microns in diameter.

EXAMPLE 2

The procedure of Example 1 was repeated in a multiple pass recycle experiment to evaluate the effect of using a more dilute solution of ammonium heptamolybdate in making up the emulsion of solution in recycle oil and to carry the hydrocyclone separation and recycle process through more passes for a longer term evaluation. A solution of one part ammonium heptamolybdate in fifteen parts of water was emulsified in a 40–60 coal-recycle oil slurry to give a starting concentration of 275 ppm Mo based on coal and this amount of molybdate solution was added (in emulsion) at each successive pass. The hydrocyclone was operated so as to give a 70–30 split of overflow to underflow.

The buildup of catalyst concentration in the feed and the ratios of concentrations of ash and catalyst components in the underflow and overflow fractions from the hydrocyclone for ten successive passes under these conditions are shown in Table II.

TABLE II

| Pass No. | Mo Content in Feed, ppm | Concentration Ratio Underflow/Overflow | | |
|---|---|---|---|---|
| | | Ash | Fe | Mo |
| 1 | 275 | 3.45 | 5.22 | 1.26 |
| 2 | 352 | 3.41 | 4.92 | 1.18 |
| 3 | 383 | 3.15 | 4.87 | 1.17 |
| 4 | — | 2.89 | — | — |
| 5 | 424 | 2.58 | 3.77 | 1.11 |
| 6 | 454 | 2.45 | 3.46 | 1.11 |
| 7 | 501 | 2.29 | 3.05 | 1.10 |
| 8 | 565 | 2.23 | 2.74 | 1.02 |
| 9 | 590 | 2.21 | 2.54 | 0.96 |
| 10 | 615 | 2.06 | 2.48 | 0.97 |

EXAMPLE 3

A coal-recycle oil slurry containing 110 ppm Mo as emulsified ammonium heptamolybdate solution was hydrogenated as described in Example 1. The heavy oil slurry contained 130 ppm Mo according to X-ray fluorescence examination. The bulk of the solids in the heavy oil slurry was separated from the remainder of the slurry by heating the slurry to 110° C and centrifuging the hot slurry in a continuously fed six-inch solid bowl Bird centrifuge. The underflow from the centrifuge amounted to 9.53 percent of the total material fed to the centrifuge. Samples of the centrifuge feed and the clarified liquid and solids products from the centrifuge were analyzed for ash. Iron and molybdenum were calculated from the material balance.

TABLE III

| Material | Wt. % Ash | ppm Fe | ppm Mo |
|---|---|---|---|
| Centrifuge feed | 4.62 | 6000 | 131 |
| Clarified liquid product | 1.83 | 1700 | 91 |
| Solids product | 33.4 | 47000 | 530 |
| Concentration Ratio solids/liquid | 18 | 28 | 5.8 |

The average diameters of catalyst and ash particles in the hydrogenated product were essentially the same as those in the foregoing example. The results listed in Table III are similar to those of Example 1 in that the centrifuge removed ash and iron from the underflow oil much more efficiently than it removed molybdenum. The clarified oil from the centrifuge would thus provide a useful source of recycle oil containing a substantial proportion of suspended molybdenum catalyst and a significant amount of catalyst recycle would thereby be achieved.

We claim:

1. In the process wherein a slurry of coal in a hydrocarbon oil is reacted with hydrogen at elevated temperature and pressure in the presence of a dispersed metal-containing hydrogenation catalyst to produce a largely liquid product containing suspended particles of ash and said catalyst, the improvement wherein the hydrogenation catalyst is provided in the form of particles substantially smaller in average diameter than the particles of ash, subjecting said liquid product to a gravity concentration process, thereby forming an upper oil layer having suspended therein a comparatively large proportion of the catalyst particles and a lower heavy layer containing a major proportion of the ash particles, separating said upper layer from said lower layer, and recycling at least a portion of said upper layer containing suspended catalyst particles to the coal hydrogenation process.

2. The process of claim 1 wherein the gravity concentration is effected in a hydraulic centrifugal separator.

3. The process of claim 2 wherein the separator is a hydrocyclone.

4. The process of claim 2 wherein the catalyst particles suspended in the upper oil layer comprise about 20–90 percent by weight of the catalyst present in the reacted coal slurry.

5. The process of claim 4 wherein the suspended catalyst particles comprise about 60–80 percent of the catalyst in the reacted slurry.

6. The process of claim 1 wherein the average diameter of the ash particles is larger than the average diameter of the catalyst particles by a factor of at least about $\sqrt{2}$.

7. The process of claim 2 wherein the hydrogenation catalyst is initially present in the coal slurry as an emulsion in the hydrocarbon oil of a water solution of at least one metal compound convertible under the hydrogenation process conditions to a catalytically active form.

8. The process of claim 7 wherein the metal compound is an alkali metal or ammonium molybdate.

9. The process of claim 8 wherein the metal compound is ammonium heptamolybdate.

* * * * *